US006536858B1

(12) United States Patent
Heidmann et al.

(10) Patent No.: US 6,536,858 B1
(45) Date of Patent: Mar. 25, 2003

(54) ELEVATED BINDER BIN

(75) Inventors: Kurt R. Heidmann, Grand Rapids, MI (US); Thomas B. Eich, Palo Alto, CA (US); Karl H. Müller, Grand Rapids, MI (US); George J. Simons, Jr., Grand Rapids, MI (US)

(73) Assignee: Steelcase Development Corporation, Caledonia, MI (US)

( * ) Notice: Subject to any disclaimer, the term of this patent is extended or adjusted under 35 U.S.C. 154(b) by 95 days.

(21) Appl. No.: 09/723,688

(22) Filed: Nov. 28, 2000

(51) Int. Cl.[7] ..... A47B 67/02
(52) U.S. Cl. ..... 312/245; 248/225.21; 52/36.6
(58) Field of Search ..... 312/196, 245, 312/246, 247, 140.4, 322, 323; 108/59, 60, 61, 102, 47, 50.01, 50.02; 52/36.5, 36.6, 239; 248/225.21, 239, 250, 905

(56) References Cited

U.S. PATENT DOCUMENTS

| | | | | |
|---|---|---|---|---|
| 3,425,568 | A | 2/1969 | Albright | |
| 3,514,883 | A | 6/1970 | Albright | |
| 3,986,649 | A | * 10/1976 | Heimstra | 312/245 X |
| 4,272,136 | A | 6/1981 | Sengua | |
| 4,571,906 | A | * 2/1986 | Ashton | 52/239 |
| 4,619,486 | A | 10/1986 | Hannah et al. | |
| D292,051 | S | 9/1987 | Martin | |
| 4,777,888 | A | * 10/1988 | Waterman et al. | 248/250 X |
| D303,881 | S | 10/1989 | Markus | |
| 4,883,330 | A | 11/1989 | Armstrong et al. | |
| D312,927 | S | 12/1990 | Martin | |
| D322,183 | S | 12/1991 | Martin et al. | |
| 5,094,174 | A | 3/1992 | Grund et al. | |
| 5,121,698 | A | * 6/1992 | Kelley | 312/196 X |
| D330,641 | S | 11/1992 | Zapf | |
| 5,172,969 | A | 12/1992 | Reuter et al. | |
| 5,183,319 | A | 2/1993 | Pearson et al. | |

(List continued on next page.)

FOREIGN PATENT DOCUMENTS

| | | | |
|---|---|---|---|
| EP | 458264 | * 11/1991 | 52/239 |
| JP | 05068610 | * 3/1993 | 312/245 |

OTHER PUBLICATIONS

Exhibit A Discloses a prior art binder bind first manufactured and sold more than one year ago under the tradename "SKATE" by Kimball International (2 pages).

Exhibit B Discloses a prior art binder bin manufactured and sold by Sugatsune (4 pages).

Exhibit C is a brochure entitled *Knoll–Hannah Desk System*, 18 pages, dated Oct. 1986.

Exhibit D is a brochure entitled *Knoll–Hannah Desk System*, 13 pages, undated but published in 1986.

Exhibit E is a publication entitled *Knoll–Hannah Desk System–Electrical Assembly Guide*, 12 pages, undated but published in 1986.

Exhibit F is a publication entitled *Knoll–Hannah Desk System–Assembly Guide*, 12 pages, undated but published in 1986.

*Primary Examiner*—Jose V. Chen
*Assistant Examiner*—Hanh V. Tran
(74) *Attorney, Agent, or Firm*—Price, Heneveld, Cooper, DeWitt & Litton

(57) ABSTRACT

A furniture system includes a low-height partition having a horizontal row of discrete attachment sites, such as slots on each side, and having a top surface. A binder bin has a continuous horizontal attachment feature, such as an "L" groove, along an upper portion of its rear side. A bracket system attaches the binder bin to the partition in a raised position, and includes a bent-rod top bracket and bottom brackets configured to engage the slots on opposite sides of the partition. The binder bin is initially attached at a desired location along the partition by selectively engaging the brackets with the slots and by engaging the bracket with the groove. The angle of the binder bin is adjustable with respect to the top surface of the partition by threadably finely adjusting a nut on the brackets.

19 Claims, 6 Drawing Sheets

U.S. PATENT DOCUMENTS 5,392,934 A * 2/1995 Fox ..... 312/245 X
5,409,308 A 4/1995 Reuter et al.
5,486,042 A * 1/1996 Heisler et al. ..... 312/196
5,544,593 A 8/1996 Canfield et al.
5,836,112 A * 11/1998 Lindale et al. ..... 52/36.6 X
5,845,980 A 12/1998 Fricano et al.
5,875,596 A * 3/1999 Muller ..... 52/239
5,893,616 A 4/1999 MacDonald et al.
5,979,118 A * 11/1999 Gortsema et al. ..... 52/36.6 X
5,988,576 A * 11/1999 Ehrlich ..... 248/220.21
6,076,474 A * 6/2000 Grabowski et al. ..... 312/196 X
6,113,201 A 9/2000 Bauer
6,286,276 B1 * 9/2001 Shipman et al. ..... 52/239
6,349,911 B1 * 2/2002 Feldpausch et al. .... 248/250 X

* cited by examiner

ELEVATED BINDER BIN

BACKGROUND OF PRESENT INVENTION

The present invention concerns furniture systems with storage bins, and more particularly concerns a partition system having a raised storage device or binder bin thereon.

Low-height partitions are often used to form office arrangements in building spaces. In such office arrangements, storage space is often critical—both in terms of capacity and optimal location within the office. The horizontal and vertical location of such storage space can be very important for optimal efficiency, especially where offices are minimum sized. Further, modern office layouts are often changed and rearranged, and the furniture needs to facilitate and be adapted for such change. One kind of change is for efficiency, while yet another is for personal preference. Where low height partitions are used, storage space is historically limited to a height of partition used. It is desirable to increase the available storage space in offices made from low-height partitions. Also, any solution must be aesthetically acceptable in appearance and ergonomically acceptable in function and use, and further must be structurally sound and cost effective. Further, any solution must preferably be adjustable so that visible surfaces can be accurately aligned.

Accordingly, a binder bin arrangement solving the aforementioned problems and having the aforementioned advantages is desired.

SUMMARY OF INVENTION

In one aspect of the present invention, a furniture system includes a partition, a binder bin, and brackets that support the binder bin on the partition. At least one of the brackets engage a rear face of the partition and at least one of the brackets engage a front face of the partition.

In another aspect of the present invention, a furniture system includes a partial-height partition having a top surface. A binder bin is attached to and supported by the partition, with the binder bin extending at least partially above the top surface. A bracket system supports the binder bin on the partition. The bracket system includes a threaded member that, when threadably adjusted, adjusts an angle of the binder bin relative to a top surface of the partition.

In yet another aspect of the present invention, a furniture system includes a partition having front and rear horizontal rows of discrete attachment sites. A binder bin is attached to selected ones of the front discrete attachment sites and has a continuous horizontal feature along a rear side of the binder bin. An elongated bracket for the binder bin is configured to adjustably engage selected ones of the rear discrete attachment sites. The elongated bracket is also configured to adjustably engage the continuous horizontal feature to mount the binder bin to the partition. The bracket further is adjusted in length to angularly adjust the binder bin to a position parallel a top surface of the partition.

These and other features, advantages, and objects of the present invention will be further understood and appreciated by those skilled in the art by reference to the following specification, claims, and appended drawings.

DESCRIPTION OF THE PRESENT INVENTION

Figure 1:
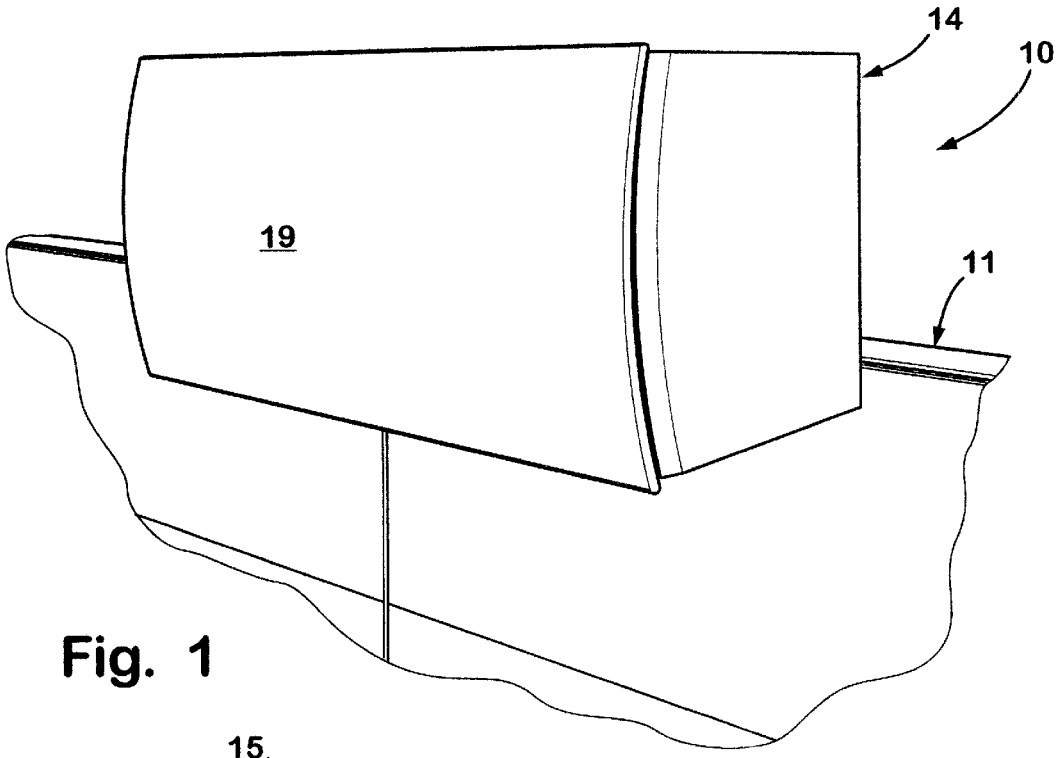
FIG. 1 is a top front perspective view of a binder bin supported in a raised position on a partition.
Figure 2:
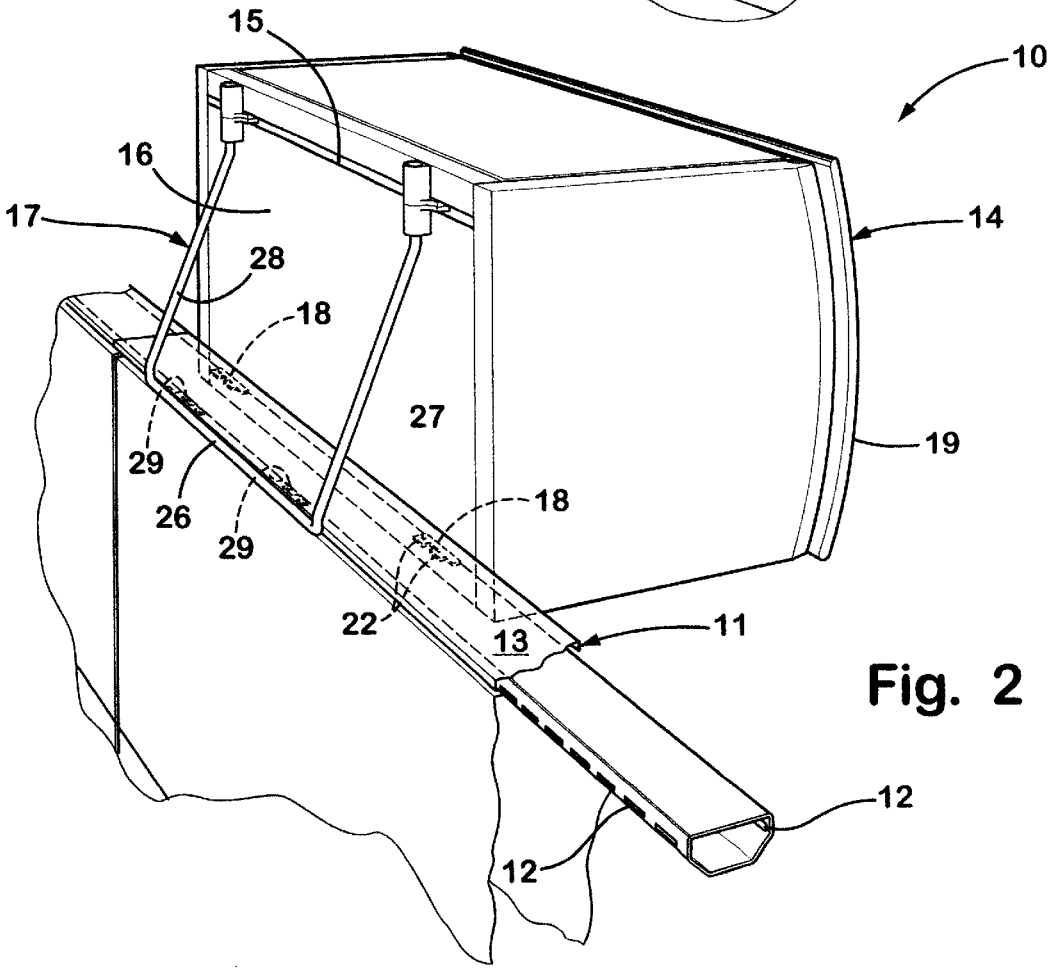
FIG. 2 is a top rear perspective view of FIG. 1.

A furniture system 10 (FIG. 1) embodying the present invention includes a low-height partition 11 having a horizontal row of discrete attachment sites, such as the illustrated slots 12 (FIG. 2) on each side, and having a top surface 13. A binder bin 14 has a continuous horizontal attachment feature, such as the illustrated "L" groove 15, along an upper portion of its rear wall 16. A bracket system includes a bent-rod top bracket 17 and bottom brackets 18 for engaging the slots 12 on opposite sides of the partition 11. The binder bin 14 is initially attached at a desired location along the partition 11 by selectively engaging the brackets 17 and 18 with the slots 12 and by engaging the bracket 17 with the groove 15. The angle of the binder bin 14 with respect to a top surface of the partition is then finely adjusted by adjusting the bracket 17, as discussed below.

Figure 3:
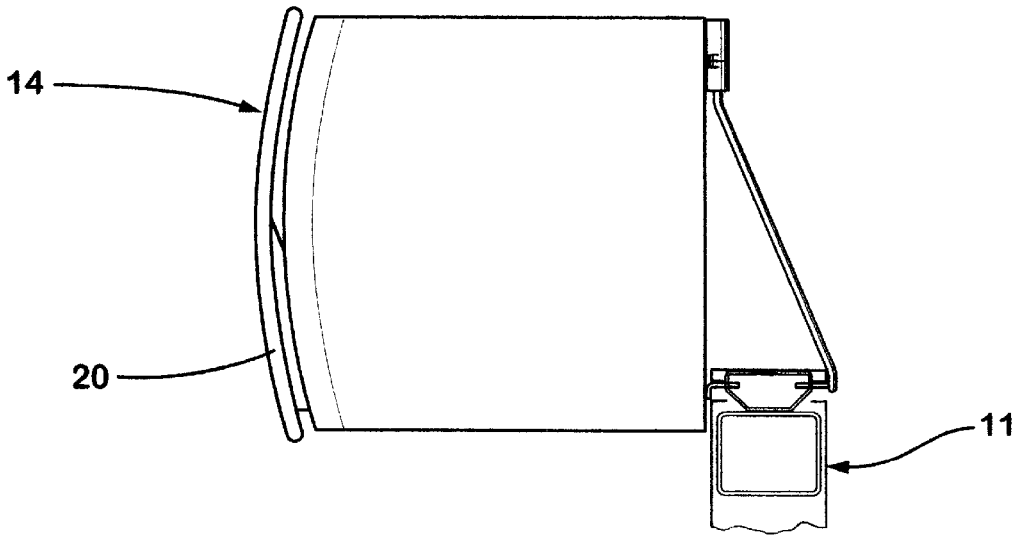
FIGS. 3–4 are side and rear views of FIG. 1.
Figure 4:
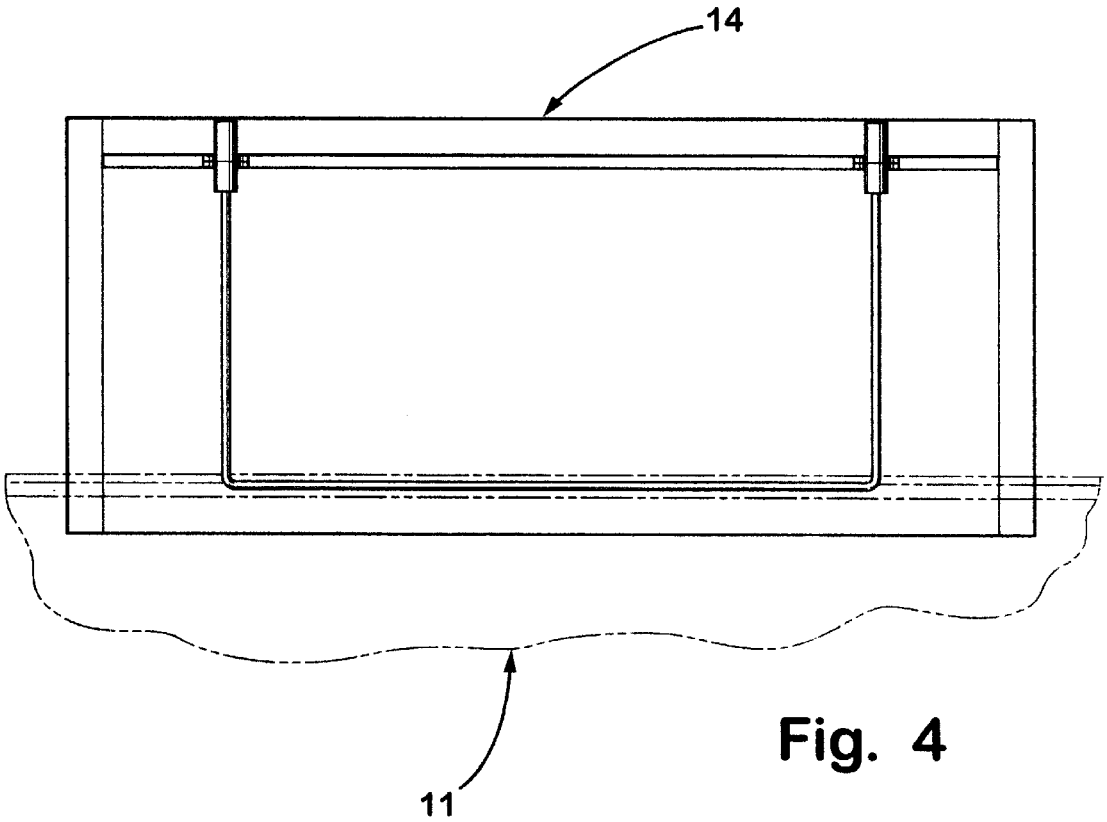

Partition-mounted binder bins and other storage devices are well known in the art, and door mechanisms for the same are also well known. For example, see U.S. Pat. No. 5,979,118, which discloses one type of closed shelf storage system, and also see U.S. Pat. No. 5,746,035, which discloses one type of partition system having a horizontal row of discrete attachment sites (i.e. slots) adapted for attachment of accessories to the partition. The disclosure of these two patents are incorporated herein in their entirety. The present binder bin 14 and its door 19 do not need to be described in detail for a person of ordinary skill in this art to understand the present invention. It is sufficient to state the door 19 is operably mounted to sidewalls of the binder bin 14 by counterbalanced arms 20 (FIG. 3).

The pair of brackets 18 (FIG. 2) are fixedly attached to a rear lower area of the rear wall 16 of the binder bin 14. The brackets 18 include hooks 22 shaped to mateably and securely engage the slots 12 in partition 11 on a first side. As illustrated, most of the binder bin 14 is located above the partition when it is attached. It is contemplated that the binder bin 14 can be designed to be higher or lower by fixing the brackets 18 higher or lower on the binder bin 14.

Figure 5A:
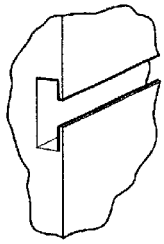
FIGS. 5A and 5B are fragmentary perspective views of alternative slot arrangements in a rear of the binder bin, the slot arrangements being similar to the rear slot in FIG. 5.
Figure 5B:
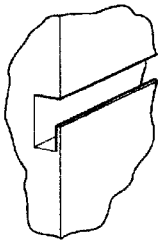
Figure 5:
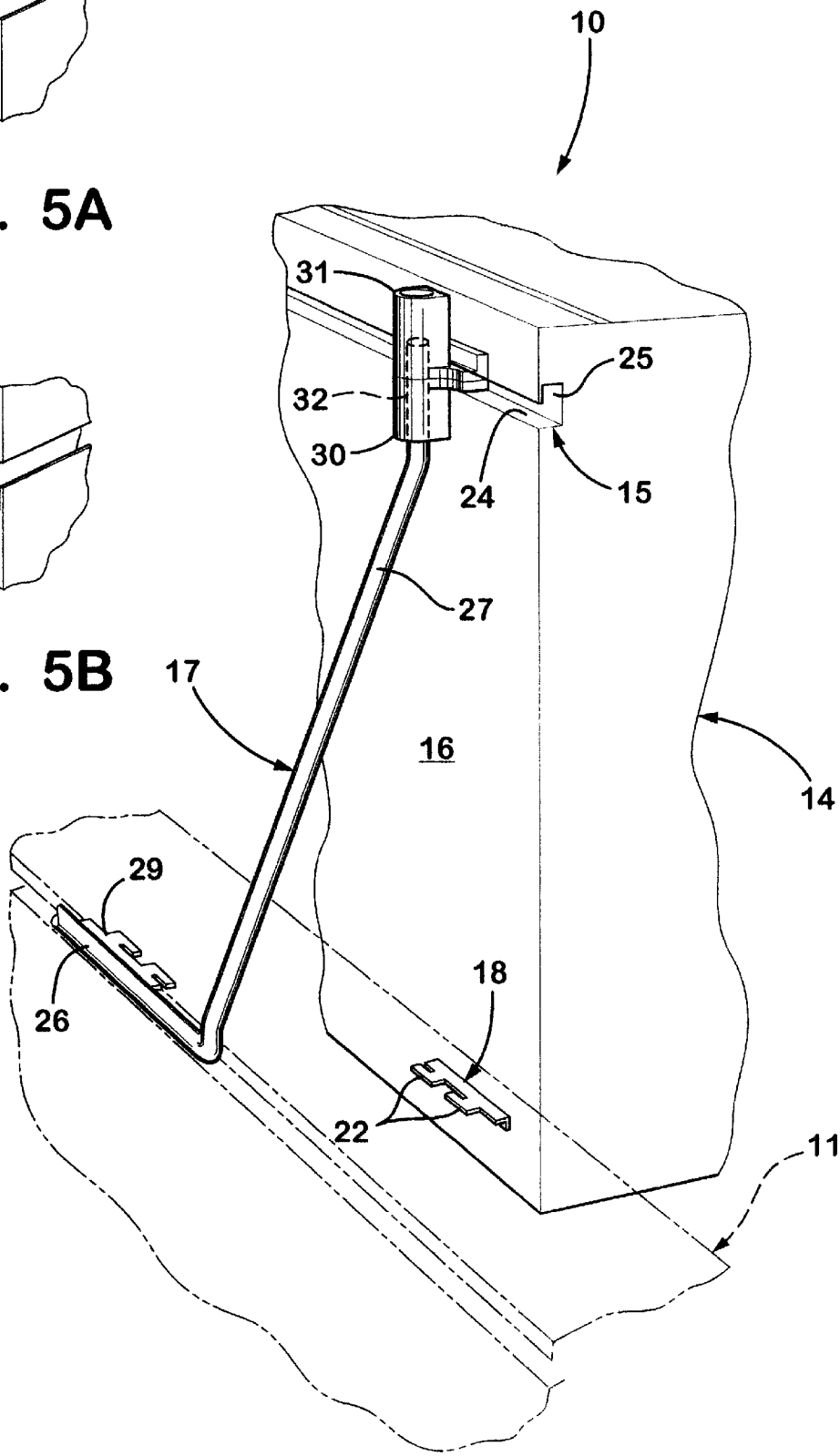
FIG. 5 is an enlarged fragmentary perspective view of a right portion of FIG. 1.

The "L" shaped groove 15 (FIG. 5) is located proximate a top of the binder bin 14 and, as illustrated, is formed at a top of the rear wall 16. The "L" groove 15 includes a horizontal leg 24 that extends horizontally into the rear wall 16, and further includes a vertical recessed leg 25 that extends upwardly from the leg 24. Notably, it is contemplated that differently shaped grooves can be used, such as a "T" groove (FIG. 5A) or an inverted "L" groove (FIG. 5B), and that non-groove features such as a rail or flange could be used.

Figure 8:
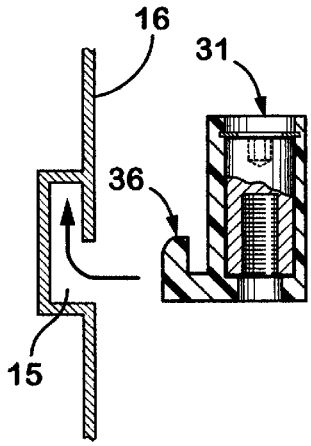
FIGS. 8–10 are exploded side views showing an assembly procedure for attaching the binder bin of FIG. 1 to the partition.
Figure 9:
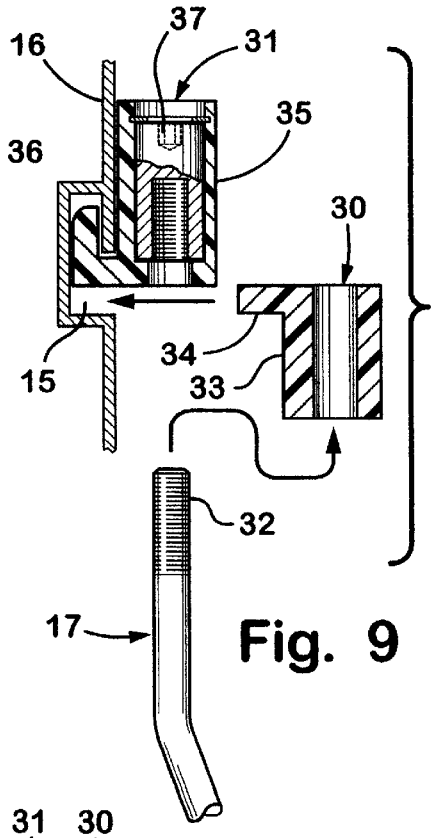
Figure 10:
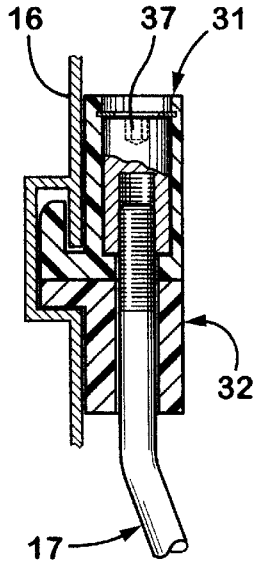
Figure 7:
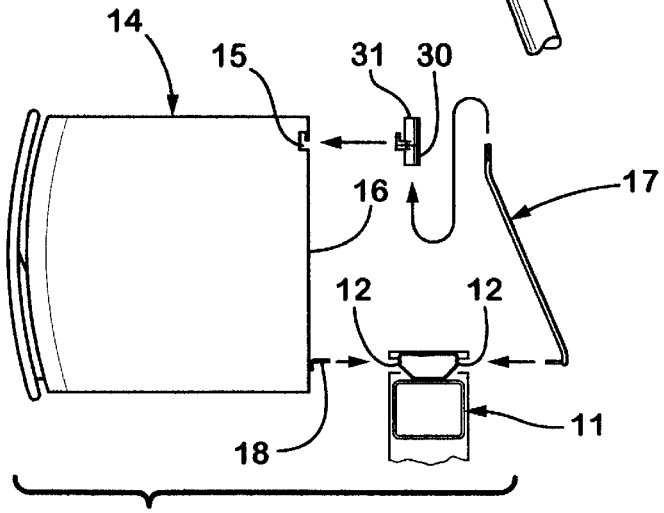
FIG. 7 is an exploded side view of FIG. 3.
Figure 6:
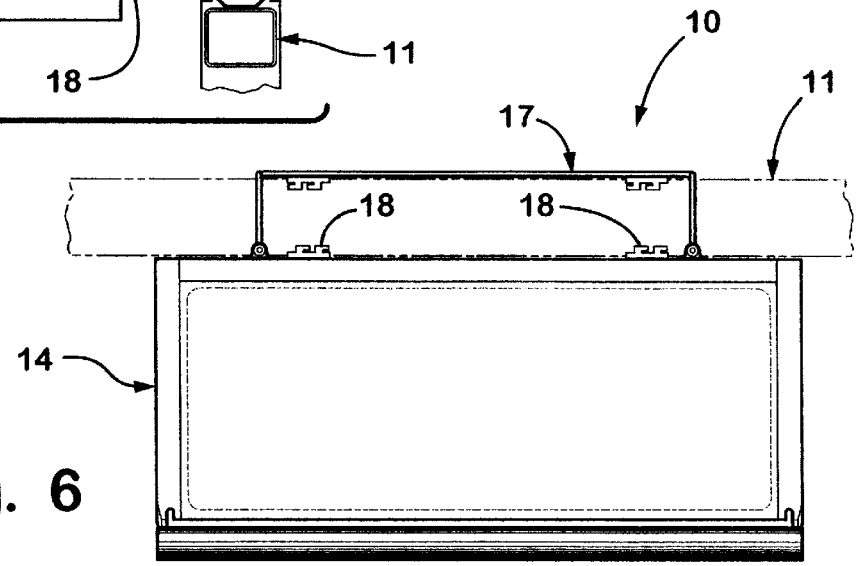
FIG. 6 is a top view of FIG. 4.
Figure 11:
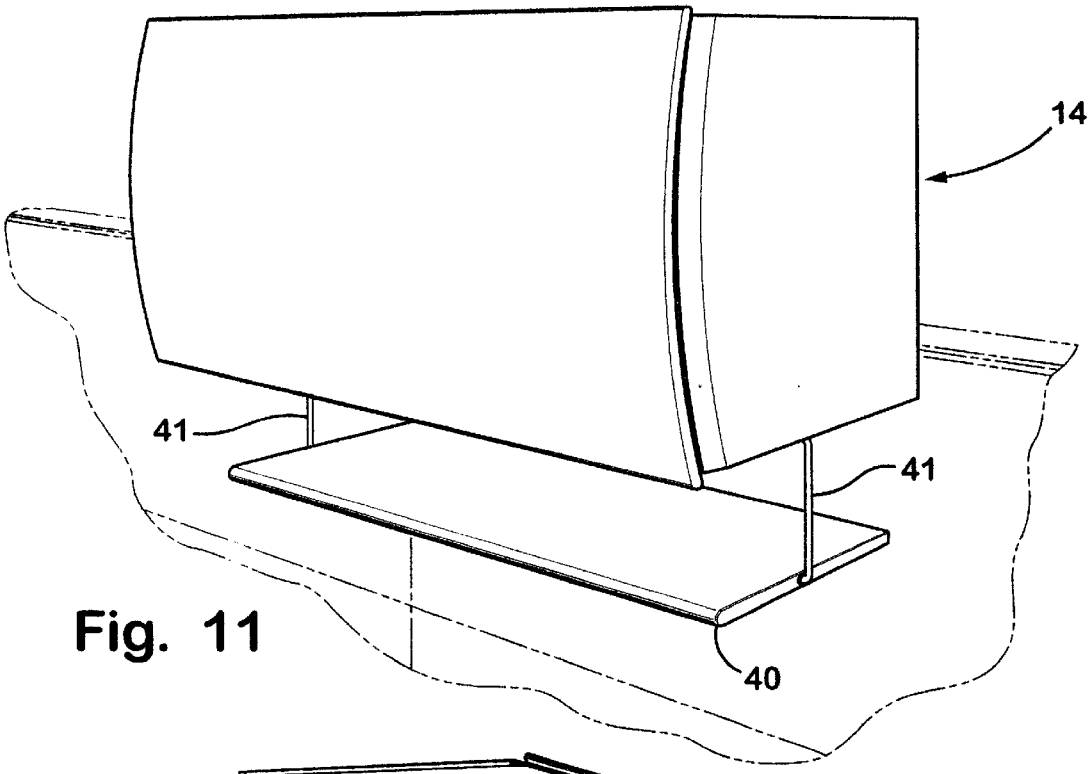
FIGS. 11–14 are front perspective, rear perspective, front and side views of a modified binder bin including a shelf mounted below the binder bin.

The bracket 17 (FIG. 2) includes a bent rod portion including a horizontal section 26 and two upwardly angled sections 27 and 28 that extend from horizontal section 26. A pair of stampings 29 (FIG. 5) are attached to the horizontal section 26 for engaging slots 12 in the partition 11 on a side opposite the brackets 18. A pair of connector blocks 30 and 31 are shaped to fit onto a threaded upper end 32 of the angled sections 27 and 28. The lower connector block 30 includes a body 33 (FIG. 9) with a hole for receiving the threaded upper end 32, and further includes a finger 34 shaped to fit into the groove 15. The upper connector block 31 includes a body 35 with a hole for receiving the threaded upper end 32, and also includes a finger 36 shaped to fit into the groove 15. The finger 36 includes an up flange so that when mated together with the finger 34, the two connector blocks 30 and 31 cannot be removed as a unit from the groove 15. A rotatable nut 37 fits downwardly into a recess in the upper body 35 for threadably engaging the threaded upper end 32. As shown by the sequence of FIGS. 8–10, one assembly sequence is to first install the upper connector block 31 in the groove 15 (FIG. 8), then install the lower connector block 30 (FIG. 9) into the groove, and then insert the threaded upper end 32 of the rods of the bracket 17 upwardly into the two blocks 30 and 31. By rotating the nut 37, the nut 37 engages the upper end 32 such that bracket 17 holds the binder bin 14 on the partition 11. As the nut 37 is further tightened, the nut angularly adjusts the bracket 17 to hold the binder bin 14 at a selective angular position relative to a top surface of the partition 11. Thus, the nut 37 permits angular adjustment of the binder bin 14 so that the binder bin 14 can be adjusted to be parallel to a top surface of the partition 11, which can be very important since angular alignment is very visible to a user of the binder bin and can be interpreted to be representative of poor quality unless the alignment is good.

A locking clip (not specifically shown) can be used to assure that the hooks of brackets 17 and 18 do not unexpectedly come loose during use of the binder bin 14.

Figure 12:
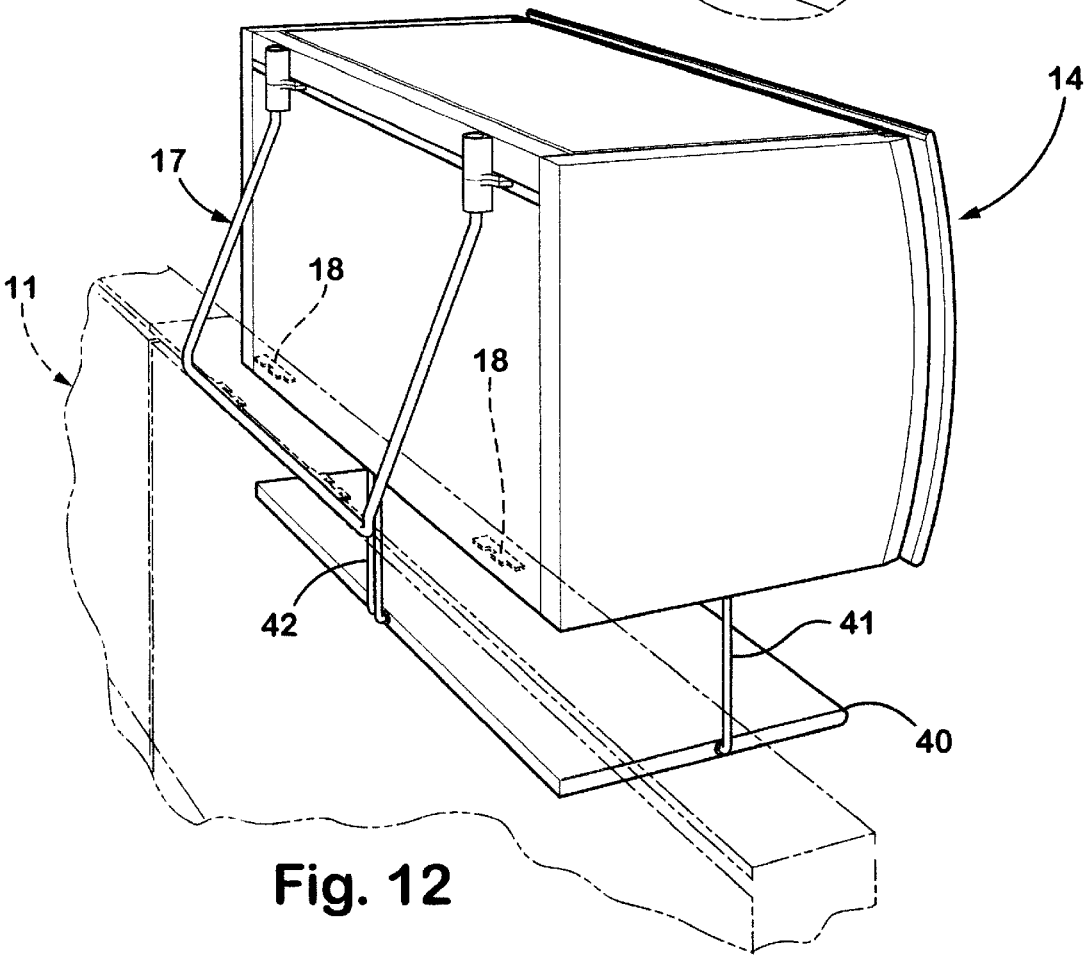
Figure 13:
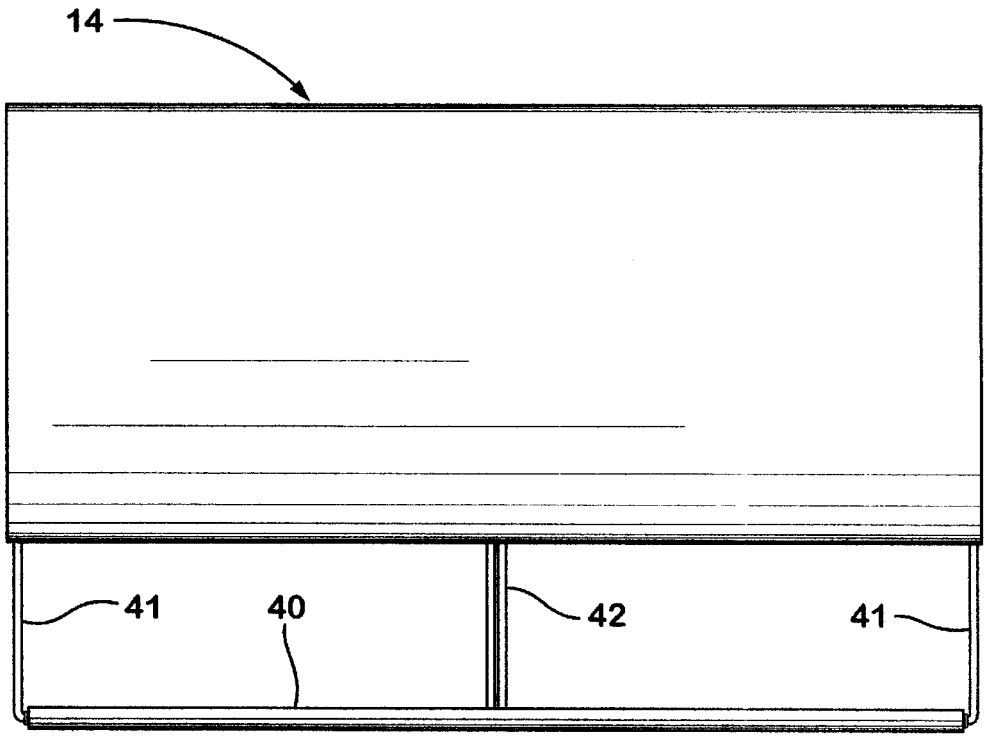
Figure 14:
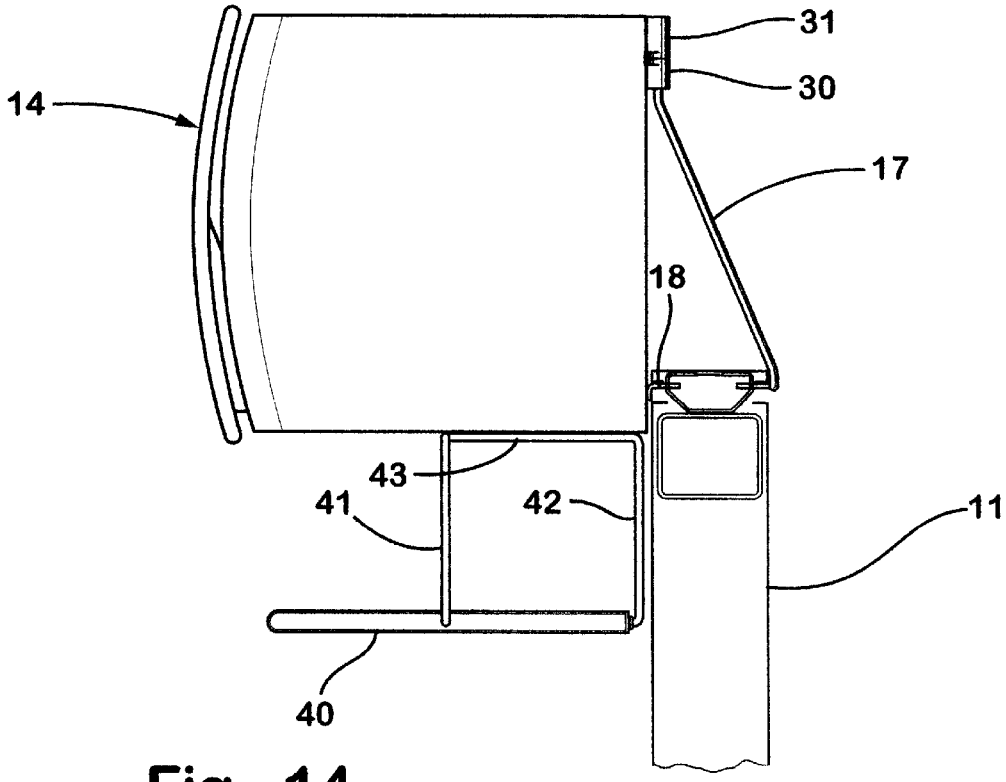

A shelf 40 (FIG. 12) is supported under the binder bin 14 by opposing side brackets 41 and a plurality of rear brackets 42. The illustrated side brackets 41 comprise bent rods having a top fastened to the bottom of the binder bin 14 (such as by a hook-shaped end of the bent rod engaging and supported by a side edge of the bottom wall of the binder bin), and having a bottom fastened to the shelf (such as by a hook-shaped end of the bent rod engaging and supported by a side edge of the shelf 40). The illustrated brackets 41 each include a single bent rod that engages a middle rear portion of the bottom wall of the binder bin 14 and a middle rear portion of the shelf 40. It is contemplated that additional brackets 41 can be used, and that they can be located in locations other than in a middle of the shelf 40 or of the binder bin 14. The rear brackets 42 include bent rod sections that are similar to those of brackets 41. Specifically, the rear brackets 42 include rod sections with a bent upper end that engages a center and rear of the bottom wall of the binder bin 14, and further include a lower end bent to engage a center and rear of the shelf 40. If desired, the brackets 41 and 42 can be formed from a single section of rod, with the upper ends being connected by a rod section 43 (FIG. 14). The shelf is highly open, such that it can be accessed from both of its sides as well as from a front of the shelf, with the brackets 41 and 42 serving to hold items on the shelf 40 while still permitting wide and open access to the shelf 40.

In the foregoing description, those skilled in the art will readily appreciate that modifications may be made to the invention without departing from the concepts disclosed herein. Such modifications are to be considered as included in the following claims, unless these claims by their language expressly state otherwise.

The present invention claims:

1. A furniture system comprising:

a partition;

a binder bin extending at least partially below and above a top surface of the partition; and brackets supporting the binder bin on the partition, at least one of the brackets engaging a rear face of the partition and at least one of the brackets engaging a front face of the partition.

2. The furniture system defined in claim 1, wherein the bracket engaging the rear face comprises a top bracket, and the bracket engaging the front face comprises a bottom bracket.

3. The furniture system defined in claim 2, wherein at least about half of the binder bin extends above a top surface of the partition.

4. The furniture system defined in claim 1, wherein the brackets include a top bracket that comprises an angled elongated member extending from the binder bin to the partition.

5. The furniture system defined in claim 4, wherein the top bracket includes a bent rod that extends between the binder bin and the partition in a tensioned arrangement.

6. The furniture system defined in claim 1, wherein the partition includes a horizontal top frame member having discrete attachment sites thereon, the discrete attachment sites including a horizontally-extending row of slots along the partition, and wherein the top bracket includes horizontally extending hooks shaped to selectively engage particular slots in the horizontal row of slots in the partition.

7. The furniture system defined in claim 1, including a shelf and vertically-elongated brackets supporting the shelf under the binder bin.

8. A furniture system comprising:

a partition;

a binder bin; and brackets supporting the binder bin on the partition, at least one of the brackets engaging a rear face of the partition and at least one of the brackets engaging a front face of the partition, the bracket engaging the rear face being a separate top bracket and the bracket engaging the front face being a separate bottom bracket;

wherein at least about half of the binder bin extends above a top surface of the partition, and wherein the top bracket engages a top area on the binder bin and also engages the rear face of the partition.

9. The furniture system defined in claim 8, wherein the bottom bracket engages a bottom area on the binder bin and engages the front face of the partition.

10. A furniture system comprising:

a partition;

a binder bin; and brackets supporting the binder bin on the partition, at least one of the brackets engaging a rear face of the partition and at least one of the brackets engaging a front face of the partition;

wherein the brackets include a top bracket that comprises an angled elongated member extending from the binder bin to the partition, and wherein the binder bin includes a horizontally-extending feature, and the top bracket adjustably engages the feature on the binder bin.

11. The furniture system defined in claim 10, wherein the horizontally-extending feature includes a groove along back of binder bin.

12. A furniture system comprising:

a partial-height partition having a top surface; and a binder bin attached to and supported by the partition, the binder bin extending at least above the top surface; and a bracket system supporting the binder bin on the partition, the bracket system including a threaded member that, when threadably adjusted, adjusts an angle of the binder bin relative to a top surface of the partition.

13. The furniture system defined in claim 12, wherein the threaded member includes a tie rod extending between the partition and the binder bin.

14. A furniture system comprising:

a partial-height partition having a top surface; and a binder bin attached to and supported by the partition, the binder bin extending at least above the top surface; and a bracket system supporting the binder bin on the partition, the bracket system including a threaded member that, when threadably adjusted, adjusts an angle of the binder bin relative to a top surface of the partition;

wherein the threaded member includes a tie rod extending between the partition and the binder bin, and wherein the tie rod extends at one angle between a rear face of the partition to a rear wall of the binder bin.

15. The furniture system defined in claim 14, wherein the rear wall of the binder bin includes a horizontal groove, and the tie rod includes a connector shaped to mateably engage the groove.

16. A furniture system comprising:

a partition having front and rear horizontal rows of discrete attachment sites;

a binder bin being attached to selected ones of the front discrete attachment sites and having a continuous horizontal feature along a rear side of the binder bin;

an elongated bracket for the binder bin that is configured to adjustably engage selected ones of the rear discrete attachment sites and also configured to adjustably engage the continuous horizontal feature to mount the binder bin to the partition, the bracket further being adjusted in length to angularly adjust the binder bin to a position parallel a top surface of the partition.

17. The furniture system defined in claim 16, wherein the continuous horizontal feature includes a long slot.

18. The furniture system defined in claim 17, wherein the long slot has an L-shaped cross section.

19. The furniture system defined in claim 18, wherein the bracket includes an end-connector for mateably engaging the long slot.

* * * * *